US005415087A

United States Patent [19]

Sniffen, Jr. et al.

[11] Patent Number: 5,415,087

[45] Date of Patent: May 16, 1995

[54] MOBILE TIE BANDING APPARATUS

[75] Inventors: Gerard J. Sniffen, Jr., Matthews; John H. Blanchfield; Kenneth D. Roberts, both of Charlotte; Randy L. Barnhardt, Concord, all of N.C.

[73] Assignee: Norfolk Southern Railway Co., Norfolk, Va.

[21] Appl. No.: 183,948

[22] Filed: Jan. 21, 1994

[51] Int. Cl.[6] ..... B65B 57/14

[52] U.S. Cl. ..... 100/4; 100/7; 100/14; 414/788

[58] Field of Search ..... 100/2–4, 100/7, 14; 414/788, 789.7

[56] References Cited

U.S. PATENT DOCUMENTS

| | | | |
|---|---|---|---|
| 2,387,658 | 10/1945 | Gruber et al. | 100/7 X |
| 3,127,829 | 4/1964 | Rossi | 100/7 X |
| 3,135,076 | 6/1964 | Hill | 100/7 X |
| 3,497,084 | 2/1970 | Murrah | 100/7 X |
| 3,511,173 | 5/1970 | Morrow | 100/7 |
| 3,783,773 | 1/1974 | Willard et al. | 100/7 |
| 3,831,511 | 8/1974 | Back | 100/14 X |
| 3,956,982 | 5/1976 | Hill et al. | 100/7 X |
| 5,027,700 | 7/1991 | Tschesche | 100/14 X |

*Primary Examiner*—Stephen F. Gerrity
*Attorney, Agent, or Firm*—Watson, Cole, Grindle & Watson

[57] ABSTRACT

A vehicle supports a first roller conveyor having stop members at opposite sides of the vehicle mounted for pivotal movement between the rollers of the first conveyor to assist in stacking ties on the first conveyor from either side of the vehicle. The first conveyor feeds stacks of ties into a horizontal compression means and a vertical compression and banding means for banding stacks of ties. A second roller conveyor feeds banded stacks of ties away from the banding means. Dump arms at opposite sides of the vehicle are mounted for pivotal movement between the rollers of the second conveyor to dump banded stacks of ties to either side of the vehicle. Hydraulic motors drive the conveyors, and a sensor is provided adjacent the second conveyor to sense the position of a stack of ties, the operation of the hydraulic motors being responsive to the sensor.

16 Claims, 4 Drawing Sheets 10
12
14
16
18
20
30
32
33
34
40
42
46
48
50
50'
52
52'
56
60
60'
64'
70
72
74
76
78
80
82
84
86
88
110
112
114
116
120
144
202
214
216
218
250
252
254
260
270
276
280
282

MOBILE TIE BANDING APPARATUS

BACKGROUND OF THE INVENTION

The present invention is directed to apparatus for picking up and packaging loose railroad track cross ties. Such loose ties are produced during track repair operations involving the removal of old cross ties which are replaced with new ones. It is undesirable to leave loose ties adjacent to a railroad track for a number of reasons, and therefore it is desirable to remove the ties as soon as possible in an efficient manner.

The procedure presently followed is to pick up the loose ties and stack them on a railroad car having a tiltable deck which supports the railroad ties. A tie crane is provided for picking up the loose ties and requires a first man to operate same. The tie crane is adapted to move along a railroad track and is a self-propelled vehicle. The tie crane can either pull or push a car having the aforesaid tiltable deck thereon. The ties are stacked on the deck by the tie crane operator. A second man manually bands the stack of ties on the railroad car. When the ties have been banded into a bundle of ties, the tie crane operator operates the tie crane so as to tilt the deck on the railroad car to one side or the other to discharge the banded bundle of ties to the ground. A work train provided with a crane subsequently picks of the bundles of ties and moves them to a remote location.

The disadvantage of this prior art procedure is that it requires two men and involves a considerable amount of manual labor. It is therefore a principal objective of the invention to provide apparatus for banding bundles of ties which can be operated by a single man and which does not require any manual labor.

SUMMARY OF THE INVENTION

The invention apparatus is a mobile vehicle which can be operated by a single man who is-the operator of the tie crane which is pushing or pulling the vehicle. Some of the movable elements of the mobile vehicle can be remotely controlled from the tie crane. The vehicle supports a horizontal compression means and a combined vertical compression and banding means. A first conveyor feeds stacks of ties into the horizontal compression means and the vertical compression and banding means. A second conveyor feeds banded bundles of ties away from the vertical compression and banding means.

A stop means is disposed adjacent the first conveyor means for assisting a crane operator in stacking ties on the first conveyor means. A plurality of stop members are disposed at either side of the first conveyor means so that ties may be stacked on the first conveyor means from either side thereof.

Dumping means is disposed adjacent the second conveyor means so that banded bundles of ties may be discharged to the ground. A plurality of dump arms are mounted for pivotal movement at each side of the the second conveyor means so that banded bundles of ties may be discharged to either side of the vehicle. Protective means is also provided for preventing damage to the second conveyor means when the banded bundles are dumped.

Sensing means is provided adjacent the second conveyor means for sensing the position of a bundle of ties on the second conveyor means to control the operation of both the first and second conveyor means as well as the compression and banding means in a manner such that the ties are sequentially indexed a certain distance by the two conveyor means to properly space the bands along the bundle of ties.

DESCRIPTION OF THE PREFERRED EMBODIMENT

Figures 1, 2:
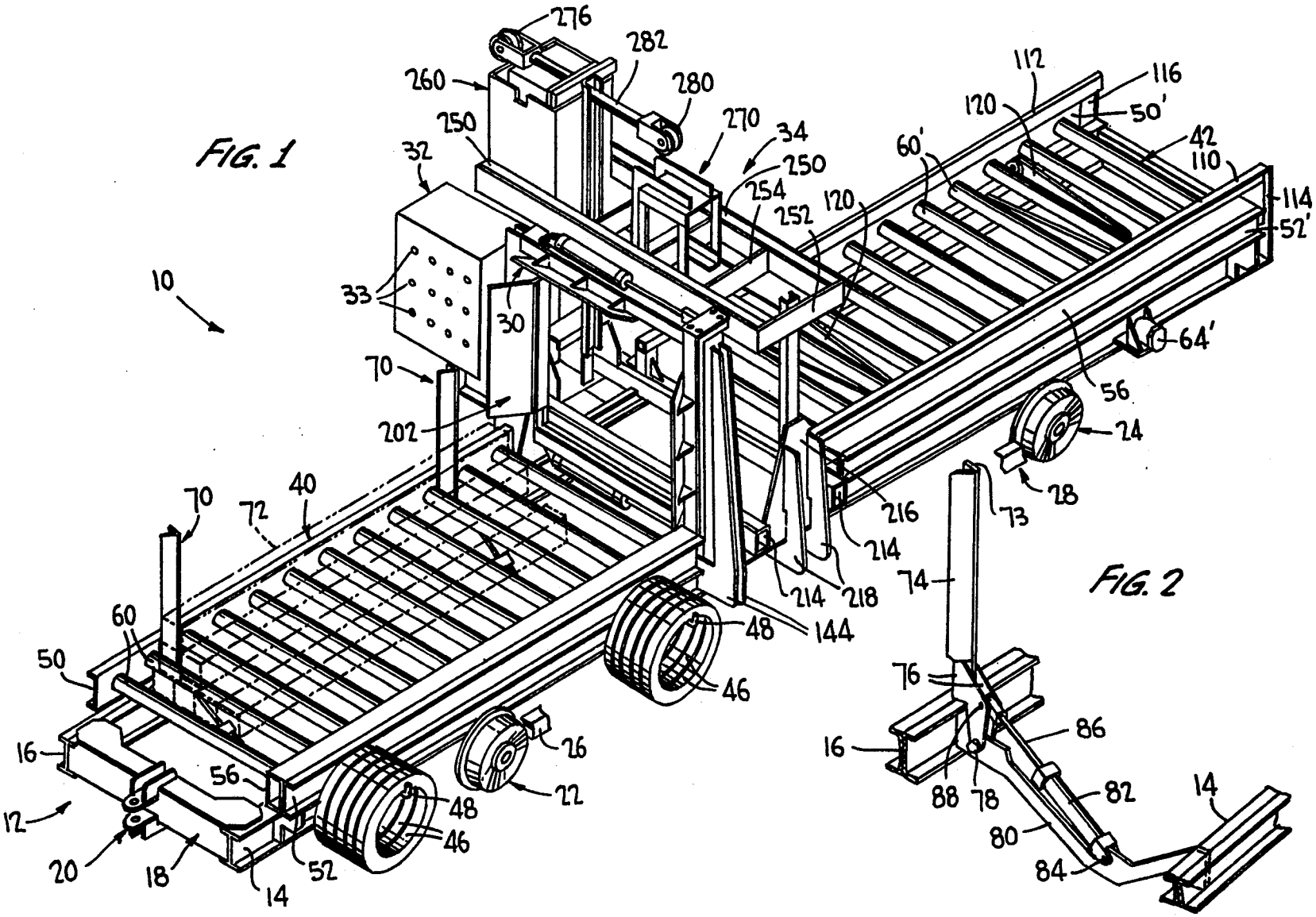
FIG. 1 is a top isometric view of the apparatus.
FIG. 2 is a top isometric view of a stop member.

Referring now to the drawings wherein like reference characters designate corresponding parts throughout the several views, as seen in FIG. 1, a mobile vehicle 10 includes a framework indicated generally by reference numeral 12 formed of a pair of spaced longitudinal steel I-beams 14 and 16 which extend the length of the vehicle. The ends of the I-beams are rigidly connected to one another at opposite ends of the vehicle by suitable cross-beam structures which are welded in place. One of the cross beam structures is indicated by reference character 18 and may include a plurality of steel plate members which are welded to one another and to the I-beams in a well-known manner. A hitch 20 is welded to cross beam structure 18 and is adapted to be connected to cooperating connecting means on a tie crane so that the mobile vehicle is moved in unison with the tie crane. In the illustrated embodiment, the mobile vehicle is pushed by the tie crane so that its movement is from left to right as seen in the drawing. The mobile vehicle may also be pulled as well as pushed if desired.

Railroad wheels 22 and 24 are mounted on conventional axle assemblies connected to the vehicle framework and are adapted to move along a railroad track. Conventional brake mechanisms 26 and 28 for wheels 22 and 24 respectively are schematically illustrated. Rubber-tired truck-type wheels as well as endless tracks may be substituted for the wheels 22 and 24, if desired. A horizontal compression means 30 is supported on the framework, and a programmable control unit 32 is supported on the framework adjacent the horizontal compression means. Control unit 32 incorporates suitable control members for electrical and hydraulic circuits of conventional construction for controlling the operation of the conveyor means, the horizontal compression means and the vertical compression and banding means of the apparatus in an automatic sequence hereinafter described. The control unit is also provided with a plurality of manually operated controls such as push buttons 33 for manually operating each function of the apparatus, if desired.

The various movable components of the apparatus are hydraulically operated. Hydraulic and electrical power is supplied from an accompanying tie crane which is provided with conventional hydraulic lines and electrical connections provided within an umbilical cable suitably connected to the apparatus in a well-known manner.

A vertical compression and banding means 34 is supported on the framework just downstream of the horizontal compression means in the direction of movement of ties which is from left to right as seen in the drawings. A first power operated conveyor means 40 is supported by the framework and is adapted to feed ties to the horizontal compression means and the banding means. A second power operated conveyor means 42 is supported by the framework and is adapted to feed ties away from the horizontal compression means and the banding means. A plurality of coils 46 of banding for the banding means are supported by suitable brackets 48 welded to I-beam 14. The banding may comprise steel banding ¾ inch wide and 0.031 inch thick.

Figure 7:
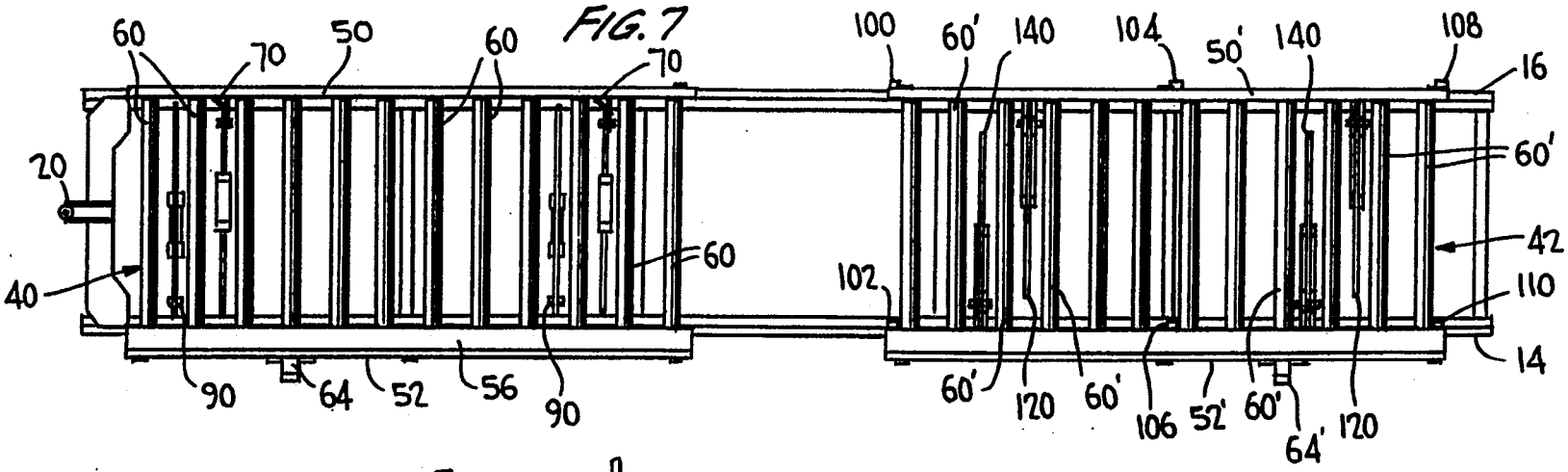
FIG. 7 is a top view of a portion of the structure shown in FIG. 1.
Figure 8:
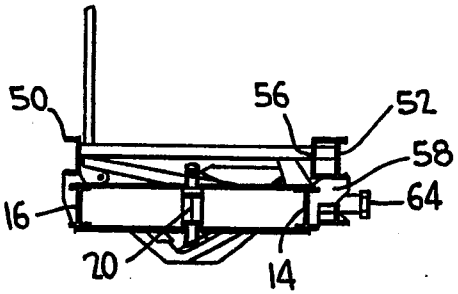
FIG. 8 is an end view of the structure shown in FIG. 7.
Figure 9:
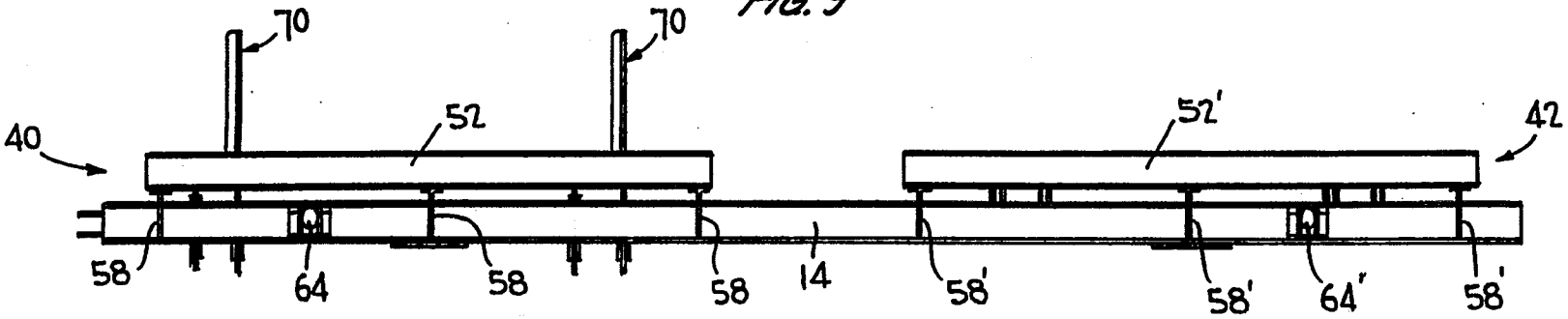
FIG. 9 is a front view of the structure shown in FIG. 7.

FIGS. 7–9, illustrate the vehicle without the horizontal compression means and the vertical compression and banding means in place. Referring to FIGS. 1 and 7–9, conveyor means 40 includes a first side element 50 in the form of a C-shaped steel beam and a second side element 52 in the form of a C-shaped beam with a cover 56 bolted thereto so as to service components therein. The side elements 50 and 52 are supported above the I-beams 16 and 14 respectively by means of a plurality of spaced steel support members 58 which are welded to the I-beams and the side elements. Conveyor means 42 is of similar construction to conveyor means 40, and accordingly, the components of conveyor means 42 have been given the same reference numerals primed as the components of conveyor means 40. As seen in FIG. 9, the side elements 50' and 52' are supported above the I-beams 16 and 14 respectively by support members 58'. A plurality of conventional conveyor rollers 60 and 60' are rotatably supported by the side elements 50, 52 and 50', 52' respectively in the usual manner.

The ends of the rollers 60 and 60' within the covers 56 and 56' respectively are each provided with a pair of sprockets (not shown) on the outer periphery thereof. Adjacent drive rollers are connected by drive chains engaging the sprockets of adjacent rollers. Conventional hydraulic motors 64 and 64' are mounted on I-beam 14 each include a pair of drive sprockets (not shown) which are connected by two drive chains (not shown) to the sprockets of two of the associated rollers of the conveyor means. The last-mentioned two drive chains extend through holes formed in the bottom of covers 56 and 56'. This type of drive connection is conventional in the conveyor art. When motors 64 and 64' are operated, all of the associated conveyor rollers are simultaneously turned to move ties supported thereon toward the horizontal compression means.

As seen in FIG. 1, a pair of similar stop members 70 are provided for assisting a tie crane operator in placing ties in position on conveyor means 40. Ties as illustrated in phantom lines 72 are initially moved into position by placing the sides of the ties against the stop members which automatically correctly positions the ties at the proper distance from the side element 50 of the conveyor means.

A stop member is seen in more detail in FIG. 2 and it will be noted that the stop member includes a first plate 73 lying in a plane generally perpendicular to the side element and a second plate 74 welded to the first plate and forming an acute angle therewith to serve as a deflector which deflects ties toward the inner edge of plate 72 when the ties are moved onto the conveyor means by the tie crane operator, thereby ensuring proper alignment of the ties on the conveyor means.

The lower end of plate 73 as seen in FIG. 2 is disposed between and welded to a pair of parallel plates 76 which in turn are pivotally connected by a bolt 78 to a cross piece 80, all of these components being formed of steel. The bolt 78 has a nut mounted on the opposite end thereof, and cross piece 80 is welded to I-beam 16 at one end thereof and is welded to I-beam 14 at the opposite end thereof. A hydraulic cylinder 82 is pivotally connected at 84 to cross piece 80, and the outer end of the piston rod 86 of the hydraulic cylinder is disposed between plates 76 and pivotally connected to the plates at 88. It is apparent that operation of the hydraulic cylinder will cause stop member 70 to pivot about the axis of bolt 78. The stop member is mounted so as to be movable between the rollers 60 of the conveyor means between the operative vertical position shown in FIG. 1 and an inoperative generally horizontal position wherein the stop member is disposed below rollers 60.

The construction of each of stop members 70 is identical, and accordingly, FIG. 2 shows the construction of each of stop members 70 and the operating mechanism associated therewith. As seen most clearly in FIG. 7, a further pair of stop members 90 is provided, the construction of these stop members and the operating mechanism as well as the mounting thereof being mirror images of the construction shown in FIG. 2. Therefore, a pair of stop members may be raised into the operative vertical position at either side of the conveyor means 40 to enable a crane operator to position ties on the conveyor means from either side of a roadbed where the loose ties lie.

Conveyor means 42 is adapted to receive banded bundles of ties and is provided with sensing means for sensing the position of the bundled ties on the conveyor means. As seen in FIG. 7, three spaced photo switch assemblies indicated schematically at 100, 104 and 108 are mounted by suitable brackets on the upper surface of C-shaped beam 50' of conveyor means 42. These assemblies include a sending and receiving portion, the sending portion emitting an infrared beam. The emitted infrared beams from the switch assemblies are adapted to impinge on infrared reflector assemblies indicated schematically at 102, 106 and 110 respectively so that the beams are reflected back to the receiving portion of the respective switch assemblies. The reflector assemblies are suspended from protective frame members hereinafter described. The sensing means is located such that it will sense the presence of ties moving along conveyor means 42.

As seen in FIG. 1, similar protective box beams 110 and 112 are provided at opposite sides of conveyor means 42 for protecting the side elements 52' and 50' from damage when a banded bundle of ties is dumped from this conveyor means. Beam 110 is welded at one end to the upper end of a vertical support 114 the lower end of which is welded to the end of I-beam 14. The opposite end of beam 110 is welded to a portion of the vertical compression and banding means 34. Beam 112 is welded at one end to the upper end of a vertical support 116 the lower end of which is welded to the end of I-beam 16. The opposite end of beam 112 is welded to a portion of the vertical compression and banding means 34. It will be noted that the protective beams are spaced above side elements 50' and 52' of the conveyor means so that a dumped banded bundle will not come into contact with these side elements of the conveyor means.

Dumping means is provided for dumping a bundle of ties from conveyor means 42. As seen in FIG. 1, a pair of similar dumping arms 120 are provided, the construction of the arms being illustrated in FIG. 5. Dumping arm 120 is pivotally supported by a bolt 122 extending through a pair of spaced steel plates 124, the bolt having a nut 126 mounted at the threaded end thereof. Plates 124 are welded to I-beam 16 and a plate 130 is also welded to the I-beam and plates 124. A hydraulic cylinder 132 is pivoted at 134 to plate 130, and the outer end of the piston rod of the cylinder is pivoted at 136 to a depending portion 138 integral with dumping arm 120.

The two dumping arms 120 are pivoted for movement between rollers 60' of conveyor means 42 and are adapted to be pivoted upwardly to an operative position where the arms are disposed at an angle of approximately 45 degrees to horizontal which is sufficient to cause a bundle of ties to be discharged to the side of the mobile vehicle. When the dumping arms are disposed in a lowered inoperative position, they are disposed below rollers 60.

Figure 5:
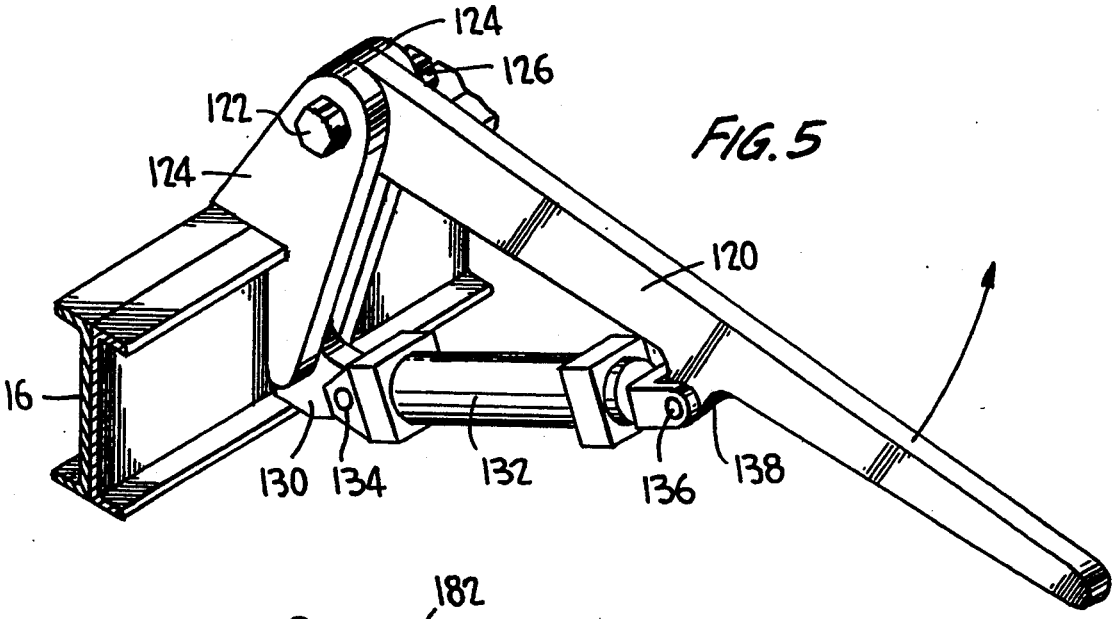
FIG. 5 is a top isometric view of a dump arm.

As seen in FIG. 7, a further pair of dumping arms 140 is provided, the construction of these dumping arms and the operating mechanism as well as the mounting thereof being mirror images of the construction shown in FIG. 5. Dumping arms 140 are supported on I-beam 14. Accordingly, a pair of dumping arms may be raised into operative position to dump a bundle of ties from conveyor means 42 onto the roadbed at either side of the mobile vehicle.

Figure 6:
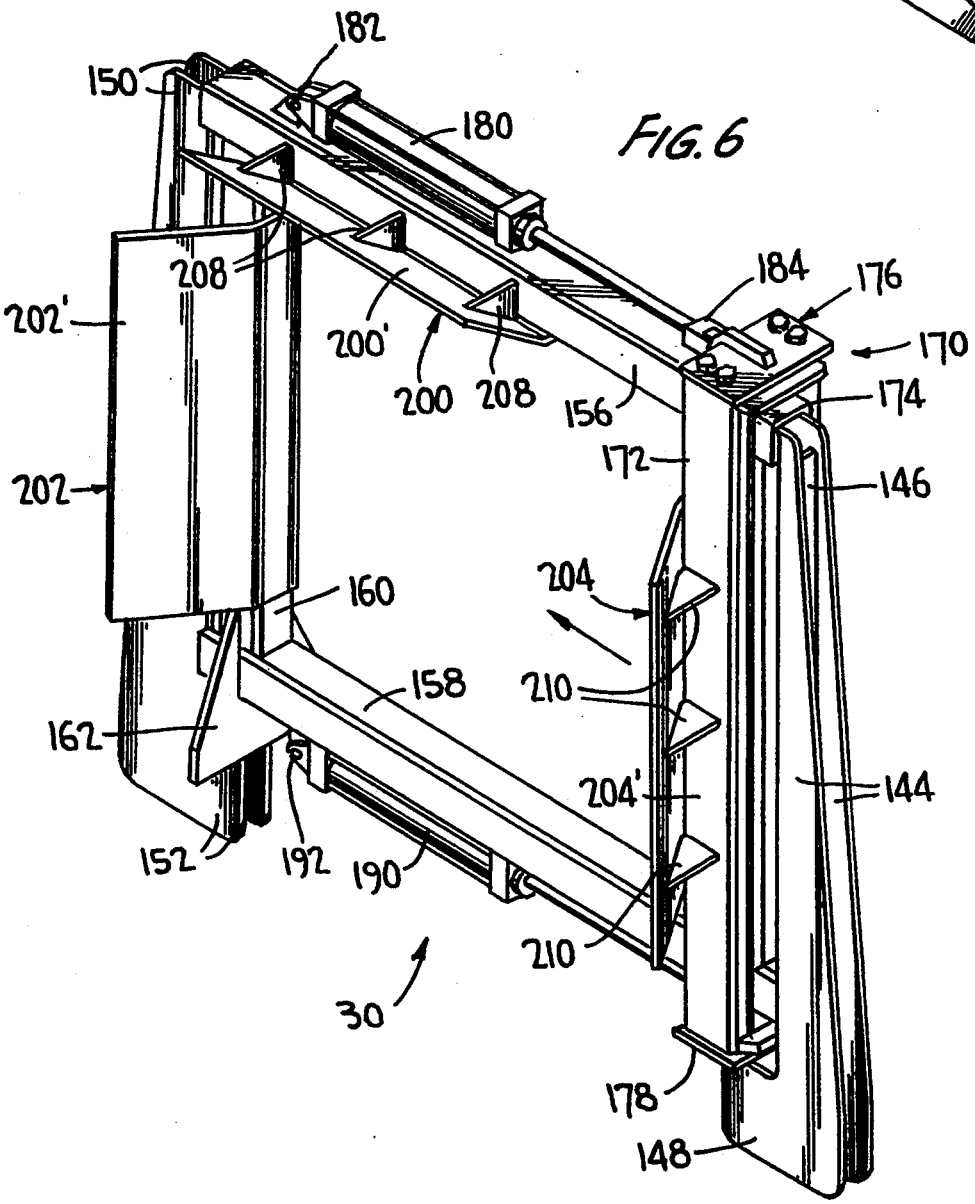
FIG. 6 is a top isometric view of the horizontal compression means.

Referring now to FIG. 6, the horizontal compression means 30 is illustrated. This compression means is formed of a plurality of steel components formed of steel and welded together to form a heavy duty construction. A first pair of vertically extending mounting gussets 144 have a plate 146 welded therebetween to rigidify the mounting gussets, and the lower ends 148 of the gussets fit within I-beam 14 and are welded thereto. A similar pair of vertically extending mounting gussets 150 have a plate welded therebetween for rigidity, and the lower ends 152 of gussets 150 fit within I-beam 16 and are welded thereto.

An upper beam 156 formed of square tubing is welded to the upper ends of gussets 144 and 150; and a lower beam 158 formed of square tubing is welded to lower portions of gussets 144 and 150. A vertical beam 160 formed of square tubing is welded at its upper end to beam 156 and at its lower end to beam 158. A gusset 162 is welded to beams 158 and 160 to reinforce the construction.

A horizontally movable assembly 170 includes a pair of spaced vertical elements 172 and 174, each of which comprises rectangular tubing, which are interconnected at their upper ends by a plate assembly 176 and are interconnected at their lower ends by a plate assembly 178 so that elements 172 and 174 are rigidly interconnected and lie on opposite sides of beams 156 and 158. A hydraulic cylinder 180 is pivotally connected to the upper surface of beam 156 at 182, and the outer end of the piston rod of the cylinder is connected by a fitting 184 with the plate assembly 176. Another hydraulic cylinder 190 is pivotally connected to the lower surface of beam 158 at 192, and the outer end of the piston rod of the cylinder is connected by a fitting similar to fitting 184 with the plate assembly 178.

Three deflector plates 200, 202 and 204 are welded to beam 156, beam 160 and elements 172 and 174 respectively, the plates including angled deflector portions 200', 202' and 204' respectively which are adapted to deflect misaligned ties so as to direct such ties toward the middle of the central opening provided within the horizontal compression means for receiving a stack of ties. Reinforcing gussets are provided between each of the deflector plates and the associated structure on which it is mounted. Reinforcing gussets 208 and 210 connected to deflector plates 200 and 204 respectively are visible in FIG. 6.

Figure 4:
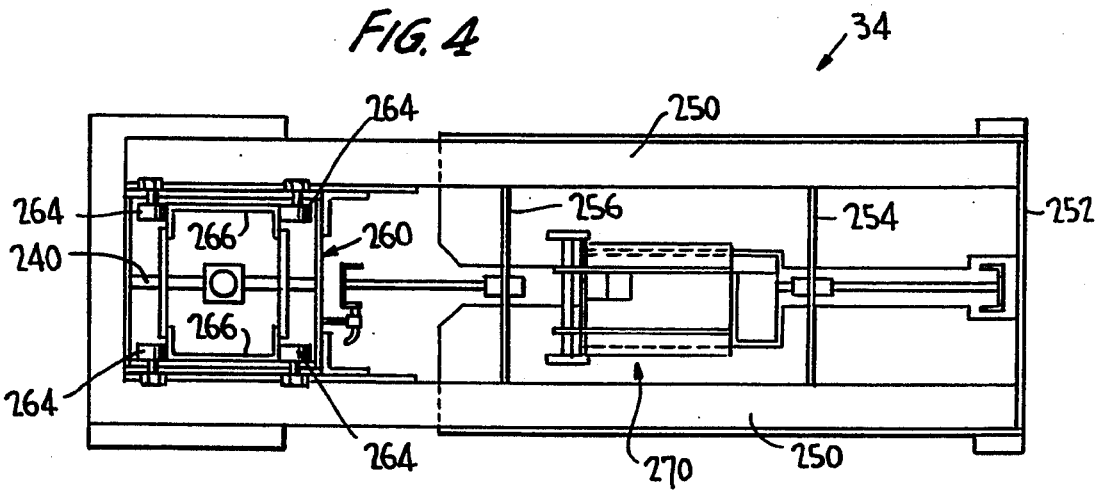
FIG. 4 is a top view of the banding means shown in FIG. 3 with certain parts removed for the purpose of illustration.
Figure 3:
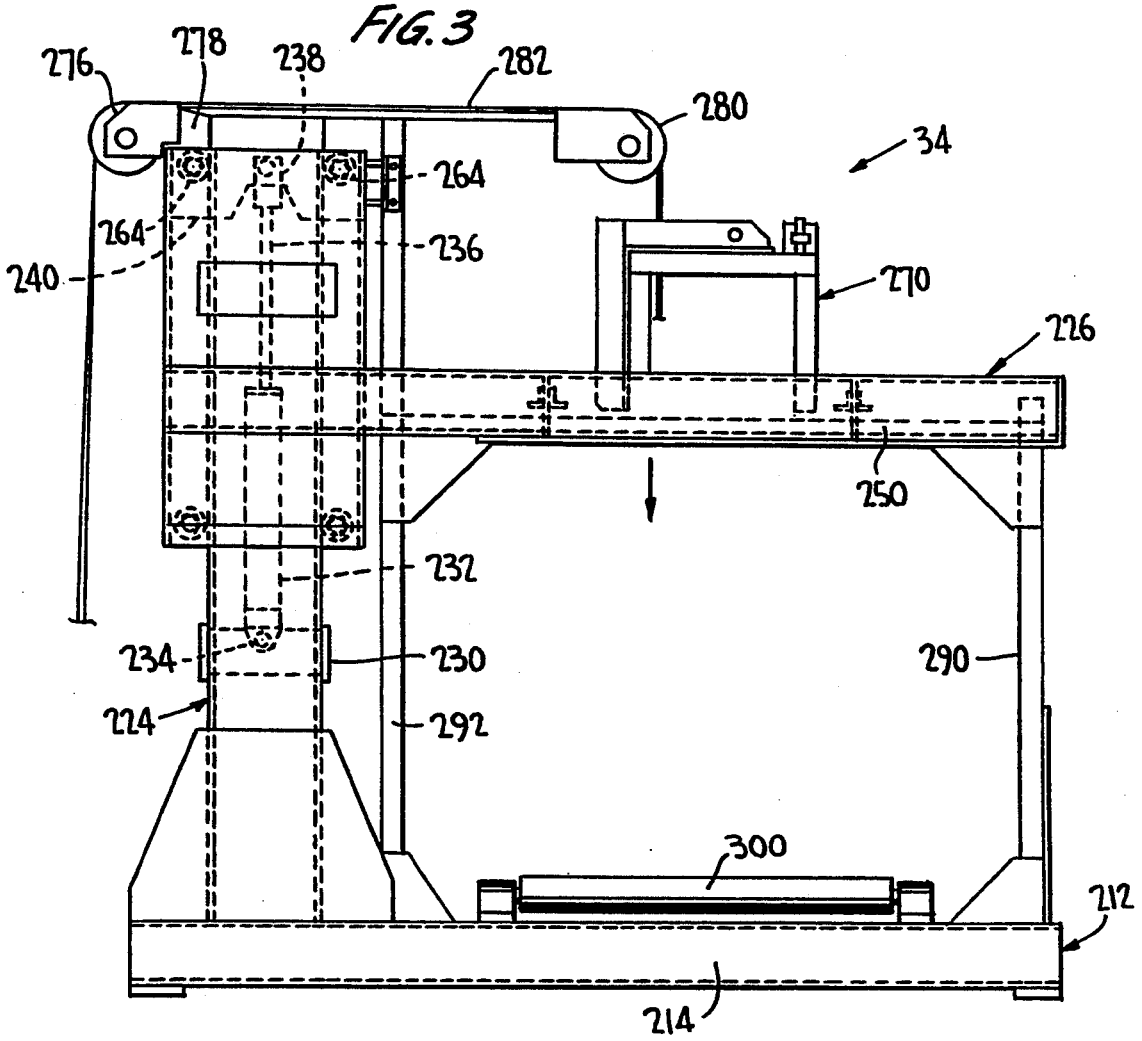
FIG. 3 is a front view of the banding means.

Referring now to FIGS. 3 and 4, the vertical compression and banding means 34 is illustrated and is of conventional construction. A main frame 212 includes a pair of parallel horizontal frame members 214 which are welded to the I-beams 14 and 16 of the mobile vehicle. As seen in FIG. 1, a plate 216 is welded along its opposite edges to frame members 214. A pair of vertically extending mounting gussets 218 are welded to plate 216 and I-beam 14. The main frame includes a vertically extending portion 224 including various members welded together to define a four-sided tubular support for the platen 226 which is vertically movable. Support structure 230 is welded to the vertical portion 224 and supports the lower end of a hydraulic cylinder 232 at 234. The upper end of the piston rod 236 of the cylinder is connected to a clevis 238 which is in turn connected to a lifting plate 240.

Platen 226 includes a horizontal portion defined by parallel tubing elements 250 interconnected by plates 252, 254, and 256 which have the opposite edges thereof welded to elements 250. The left-hand ends of elements 250 as seen in FIG. 4 are further interconnected with one another by a vertically extending four-sided tubular portion 260 formed of various members welded to one another and to elements 250. Lifting plate 240 is welded at its opposite edges to the inner surface of the tubular portion 260 so that actuation of the hydraulic cylinder will cause the platen to move up and down as desired.

The tubular portion 260 of the platen carries a plurality of guide rollers 264 which are adapted to roll along two C-shaped beams 266 which form part of the vertically extending portion 224 of the main frame to guide vertical movement of the platen. A conventional banding head 270 is carried by the platen and includes a support structure which is welded to plates 254 and 256. A feed wheel 276 is mounted on a bracket 278 supported at the upper end of vertical portion 224 of the main frame. Another feed wheel 280 is supported at the outer end of a track guide 282 supported at the upper end of vertical portion 224. Banding for the banding means is carried by a conventional powered band dispenser with an accumulator (not shown) and passes around feed wheels 276 and 280 to the banding head. The band is then fed through conventional fixed horizontal tracks supported on the platen and the main frame and fixed vertical tracks supported by vertical track supports 290 and 292 which are fixed to the main frame. An idler roller 300 is supported by the main frame 212 and serves to support a stack of ties while the vertical compression and banding mechanism is operating. The operation of the banding means is conventional and will be readily understood by one skilled in the art.

OPERATION

It is assumed that the invention apparatus is suitably connected to a tie crane so as to be moved thereby, and further that suitable connections have been made between the tie crane and the invention to provide electrical and hydraulic power thereto. The invention apparatus may be moved by other means if desired.

The stop means is operated from the control unit 32 to raise one pair of stop members in accordance with which side of the mobile vehicle he wishes to swing ties onto the first conveyor means. The ties are then loaded against the vertical stop members to form a stack of approximately four by four or sixteen ties. In the case of small ties, the stack may comprise five by five or twenty-five ties. The operator then starts an automatic banding cycle from the tie crane cab, the automatic cycle being controlled by the programmable control unit 32. The conveyor means 40 and 42 are actuated to feed the ties through the central opening in the horizontal compression means 30 and through the vertical compression and banding means 34. The banding means contains a suitable band which is fed into the head, through the tracks of the banding means and back to the head, while the platen is in its fully raised position.

The stack of ties is advanced by the conveyor means until the first sensing means 100 senses the stack of ties. The conveyor means then stops and the platen lowers to a point adjacent the top of the stack of ties. The horizontal compression means is then actuated and compresses the stack of ties from the side with approximately 10,000 pounds of force. The platen again is lowered to apply approximately 2,000 pounds of force to the top of the stack of ties. The banding head cycles in the usual manner until a band seal is made. The platen then moves upwardly to its fully raised position and the horizontal compression means retracts. Additional band is then automatically fed around the track and the horizontal compression means and the vertical compression and banding means is ready to repeat the above cycle.

The banded bundle is advanced by the conveyor means a distance of about six inches and the above cycle is repeated to place a second band around the bundle of ties. The banded bundle is then advanced by the conveyor means until sensing means 104 senses the bundle, and the conveyor means stops and the above cycle is repeated to place a third band around the bundle. The banded bundle is then advanced by the conveyor means a distance of about six inches and the above cycle is again repeated to place a fourth band around the bundle. The banded bundle is then advanced by the conveyor means until sensing means 108 senses the the bundle, and at that point the conveyor means is stopped and the completely banded bundle is ready to be dumped from the apparatus. It is apparent that any number and arrangement of bands may be applied about the bundle of ties as desired.

The dumping means may then be actuated by the operator so that the selected pair of dumping arms are raised to engage the banded bundle of ties, whereupon the bundle is discharged to one side of the mobile vehicle onto the roadbed. The various functions of the apparatus may also be carried out by manually operating the push buttons 30 on control unit 32.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. Mobile tie banding apparatus comprising, a mobile vehicle for receiving a plurality of railroad cross ties thereon, compression means supported by said vehicle for applying pressure to a plurality of ties to move the ties into a tight bundle, banding means supported by said vehicle for banding the bundle of ties, conveyor means supported by said vehicle for conveying ties to and from said compression means and said banding means so that a plurality of bands may be applied about the bundle of ties, and dumping means for dumping a banded bundle of ties from said vehicle.

2. Apparatus as defined in claim 1 wherein said compression means includes means for applying horizontal pressure and vertical pressure to a plurality of ties.

3. Apparatus as defined in claim 1 wherein said conveyor means comprises a plurality of spaced power operated rollers, control means for controlling the operation of the conveyor means, and sensing means for sensing the position of a bundle of ties on said conveyor., said control means being responsive to said sensing means to control the operation of the conveyor means.

4. Apparatus as defined in claim i including stop means adjacent said conveyor means for assisting in placing ties on said conveyor means, said stop means being mounted so as to be movable from an operative position to an inoperative position.

5. Apparatus as defined in claim 4 wherein said conveyor means comprises a plurality of spaced power operated rollers, said stop means including a plurality of stop members which are movably supported by said vehicle and which are movable between the rollers of said conveyor means.

6. Apparatus as defined in claim 1 wherein said conveyor means comprises a plurality of spaced power operated rollers, said dumping means including a plurality of dumping arms which are movable supported by said vehicle and which are movable between the rollers of said conveyor means.

7. Apparatus as defined in claim 1 wherein said conveyor means has side elements, and protective beams disposed above said side elements to protect the side elements from damage by dumped bundles of ties.

8. Mobile tie banding apparatus comprising, a framework for supporting a plurality of railroad cross ties, wheels supporting said framework for movement from one place to another, horizontal compression means supported by said framework for applying horizontal compression to a plurality of ties, banding means supported by said framework for applying vertical pressure to a plurality of ties and banding the ties to one another in a tight bundle, first power operated conveyor means supported by said framework for feeding ties to said banding means and horizontal compression means, second power operated conveyor means supported by said framework for feeding a banded bundle of ties away from said banding means and horizontal compression means, and dumping means for dumping a banded bundle of ties on either side of said framework.

9. Apparatus as defined in claim 8 wherein said horizontal compression means defines an entrance opening having a top and sides through which ties pass, said horizontal compression means including deflector means adjacent said top and sides of the opening for deflecting misaligned ties into proper alignment as they pass through the opening.

10. Apparatus as defined in claim 8 wherein each of said conveyor means comprises a plurality of spaced power operated rollers.

11. Apparatus as defined in claim 10 including means for controlling the operation of said first and second conveyor means, sensing means adjacent said second conveyor means for sensing the position of a bundle of ties on said second conveyor means, said control means being responsive to said sensing means to control the operation of both said first and second conveyor means.

12. Apparatus as defined in claim 10 including stop means adjacent said first conveyor means for assisting in placing ties on said first conveyor means, said first conveyor means having opposite sides, said stop means including a pair of stop members which are movably supported by said framework and which are movable between the rollers of said first conveyor means into operative position at one side of the first conveyor means.

13. Apparatus as defined in claim 12 including additional stop means including a further pair of stop members which are movably supported by said framework and which are movable between the rollers of said first conveyor means into operative position at the opposite side of the first conveyor means.

14. Apparatus as defined in claim 10 wherein said dumping means includes a pair of dumping arms which are movably supported by said framework and which are movable between the rollers of said second conveyor means into operative position at one side of said second conveyor means.

15. Apparatus as defined in claim 14 including an additional pair of dumping arms which are movably supported by said framework and which are movable between the rollers of said second conveyor means into operative position at the opposite side of the second conveyor means.

16. Apparatus as defined in claim 8 wherein said second conveyor means has side elements, and protective beams disposed above said side elements to protect the side elements from damage by dumped bundles of ties.

* * * * *